United States Patent [19]

Pounds et al.

[11] 4,153,108

[45] May 8, 1979

[54] WELL TOOL

[75] Inventors: Steve R. Pounds, Pearsall; Carter R. Young, Lewisville, both of Tex.; Richard J. Trahan, Gretna, La.

[73] Assignee: Otis Engineering Corporation, Dallas, Tex.

[21] Appl. No.: 859,678

[22] Filed: Dec. 12, 1977

[51] Int. Cl.[2] ..... E21B 23/02; E21B 23/04; E21B 33/124

[52] U.S. Cl. ..... 166/118; 166/120; 166/191; 166/212; 166/217

[58] Field of Search ..... 166/120, 123, 125, 118, 166/119, 127, 217, 237, 243, 181, 182, 191, 134, 207, 208, 212

[56] References Cited

U.S. PATENT DOCUMENTS

| | | | |
|---|---|---|---|
| 2,705,890 | 4/1955 | Klose | 285/264 X |
| 2,862,560 | 12/1958 | Bostock et al. | 166/217 X |
| 2,894,586 | 7/1959 | Schramm et al. | 166/125 |
| 2,901,045 | 8/1959 | Schramm | 166/125 |
| 2,948,338 | 8/1960 | Raulins et al. | 166/123 |
| 3,010,214 | 11/1961 | Postlewaite | 166/0.5 |
| 3,136,366 | 6/1964 | Brown et al. | 166/125 X |
| 3,226,977 | 1/1966 | Kolb | 175/7 |
| 3,321,217 | 5/1967 | Ahlstone | 166/0.6 |
| 3,323,360 | 6/1967 | Nutter | 166/127 X |
| 3,450,421 | 6/1969 | Harwell, Jr. | 166/0.6 |
| 3,670,815 | 6/1972 | Brown | 166/125 X |
| 3,977,707 | 8/1976 | Oliver | 285/265 |

*Primary Examiner*—Stephen J. Novosad
*Attorney, Agent, or Firm*—Vinson & Elkins

[57] ABSTRACT

A well tool such as a multiple packer which is held in the well against downward movement by engagement of the tool with the well casing such as through a no-go shoulder and held against upward movement by a latch system which after the tool is in place in the well is moved axially along the tool upwardly into engagement with a no-go shoulder in the casing and secured at this point. The tool is removed by releasing the latch assembly.

6 Claims, 8 Drawing Figures

Figures 2A, 3A, 4A:
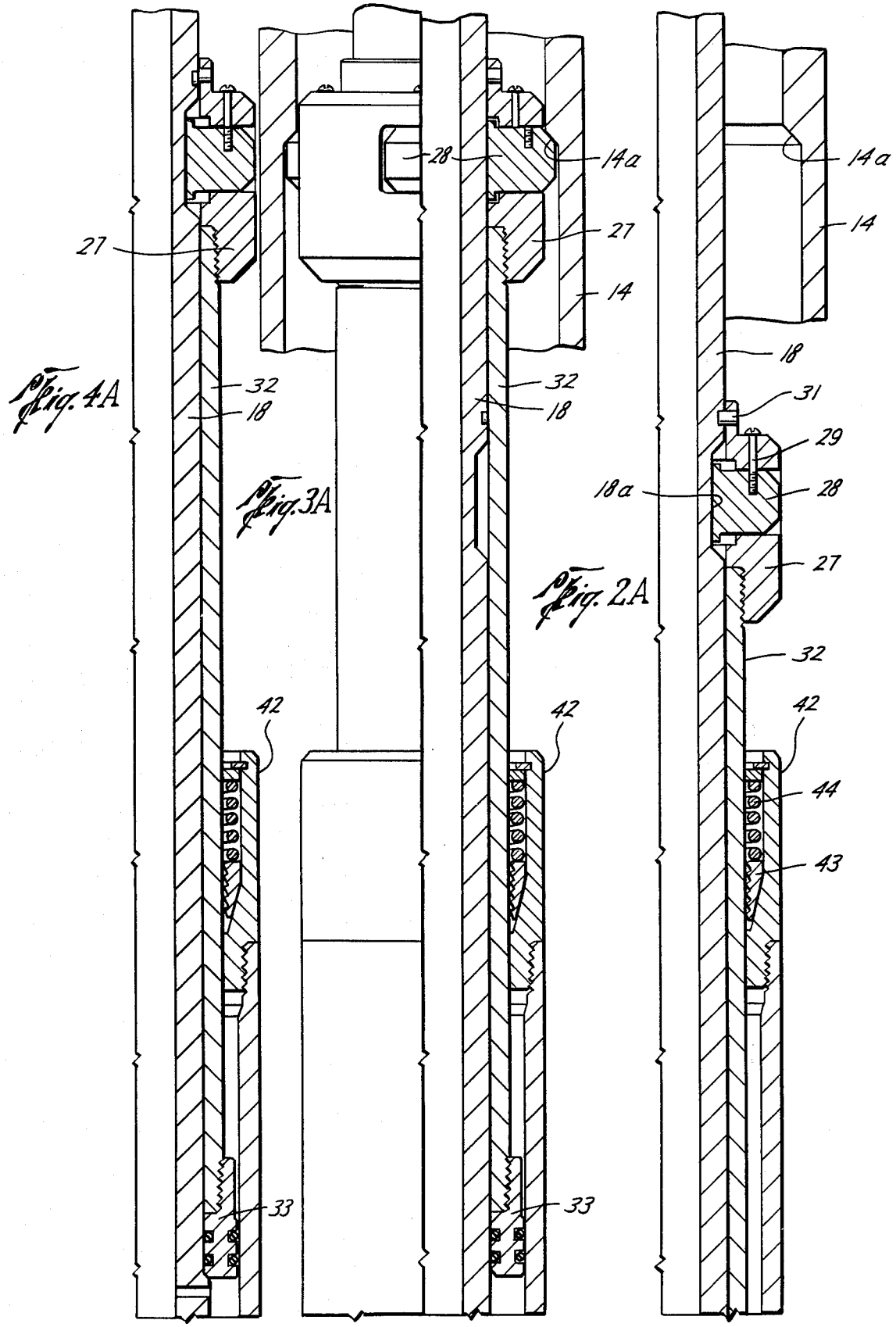

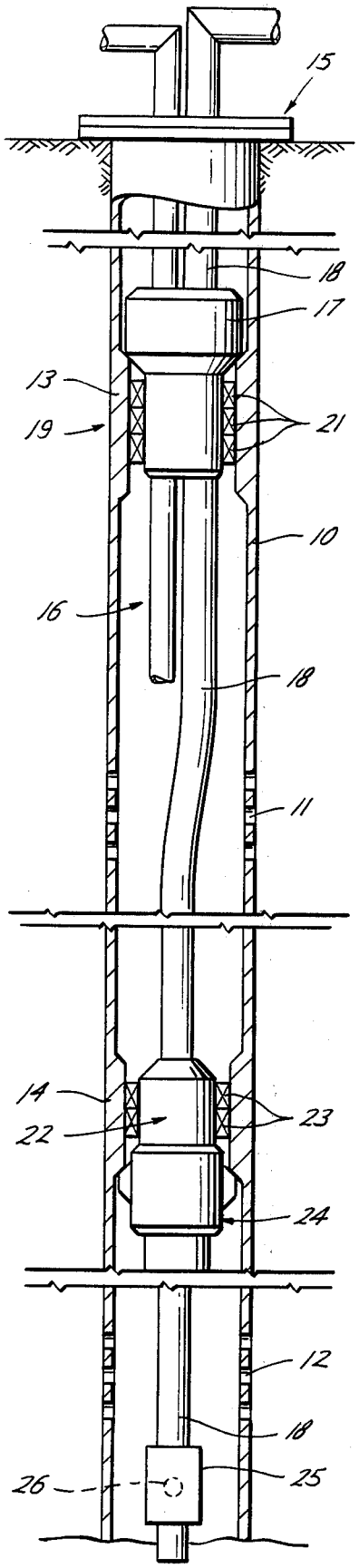
Fig. 1
Fig. 5
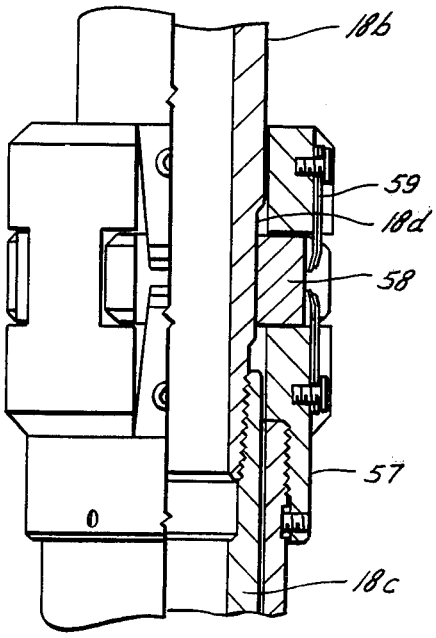

WELL TOOL

This invention relates to well tools and more particularly to a well tool such as a multiple packer assembly which may have substantial length, which by this invention is secured in the casing against movement in both directions.

It is conventional to land well tools such as single or multiple packers against downward movement by slips, no-go shoulders, latch keys, etc. It is also conventional to prevent the upward movement of well tools by various means. For instance, hydraulically actuated buttons are frequently employed which under hydraulic pressure extend out and engage the casing and inhibit upward movement of the tool. It is also conventional to latch a tool against upward movement by the use of latching lugs or keys which after they are mated with a suitable matching configuration in the casing are held in expanded position by positioning an expander behind the keys or lugs. This type of structure is shown in the U.S. Pat. to Raulins, No. 2,948,338. See also the patent to Bostock, U.S. Pat. No. 2,862,560, in which locking lugs are held in engagement in a groove in a mandrel and prevent movement of the tool in either direction. The Schramm U.S. Pat. No. 2,894,586, shows the combination of a no-go shoulder and locking lugs held in extended position. The same teaching is present in Schramm, U.S. Pat. No. 2,901,045, in which a no-go shoulder is combined with a collet in which the collet fingers are held in engagement by an expander. The no-go shoulder and collet structure are conventional commercial equipment as shown in the Composite Catalog of Oil Field and Pipe Line Equipment, 21st Edition 1955, 1956, published by World Oil. Note Page 4001 of Volume 3 which discloses the type U tools. This collet type latch has been applied to packers. See Page 3997 of the same publication.

In none of this prior teaching is it possible to place the well tool in tension. Placing the tool in tension is of particular advantage in positioning a long tool in the well where space-out problems are present and where multiple seal systems are used, such as in multiple packer installations. In such installations an upper multiple packer seals with the casing and a lower packer such as a single also seals with the casing. A substantial distance may separate the two seal systems as production would be contemplated from multiple formations. Thus, if a latch system is employed in conjunction with the upper packer to locate it in the well, it is difficult to at the same time latch the lower packer in the well due to space-out problems. It is preferable to avoid the necessity for using slips as these may balloon the casing.

There has not been known in the past a system for latching which could be utilized with multiple packers so that the multiples might be run simultaneously and the packers positively latched against movement in either direction by latches at the upper and lower end of the tool. To be able to latch at the upper and lower end of the tool is important. If the latch system were at one end of the tool say, for instance, at the upper multiple packer, the connecting tubing between the packers could corkscrew and permit the lower packer seals to become inoperative due to moving upwardly out of engagement with the casing seal bore, where polished bore receptacles are utilized. For a discussion of polished bore receptacles see the Braddick U.S. Pat. No. 3,531,236. These types of packers have substantial advantages in many instances if they can be adequately latched into position so that the seals carried on the exterior surface of the packer will remain in engagement with the polished bore in the casing nipple. This is possible with the instant invention as multiple packers will be positively locked against upward and downward movement with the intermediate tubing in tension and thus it is only necessary to provide a sufficient length of packer seals on the several packers to insure that they are initially in engagement with a polished bore, that is, sufficient seals are provided to insure resolution of any space-out problem when the upper packer is landed in the well.

It will be apparent that the same concept could be applied to a smaller tool or to a single packer and the invention would give a packer, for instance, which would have substantially all of the advantages of a permanent packer, but would be removable from the hole.

It is an object of this invention to provide a well tool which may positively be latched in the well against upward or downward movement, utilizing an upper and lower latch in which the tool between the latches may be held in tension.

It is another object of this invention to provide a well tool which may be held against vertical movement in a well by engagement of the tool with oppositely facing no-go shoulders in the well where no-gos on the well tool are positioned at the upper and lower extremities of the tool and engage mating no-go shoulders in the well casing, and in which the intervening portion of the tool between the no-gos may be held in tension.

It is another object of this invention to provide a multiple packer system in which the multiple packers may employ seals of the polished bore type and in which the connecting tubing between multiple packers is held in tension by the latching system so that it cannot corkscrew or otherwise permit the seals to become disengaged with the casing.

It is another object to provide a well tool such as a multiple packer system which may straddle a pair of spaced no-go shoulders in well casing and which has a latch system to engage the two no-go shoulders to prevent movement of the tool in either direction.

Another object is to provide a tool as in the preceding object in which the tool between the two no-go shoulders can be placed in tension.

Another object is to provide a well tool as in the preceding objects in which the latching system is releasable so that the tool may be readily retrieved.

Other objects, features, and advantages of the invention will be apparent from the Drawings, the Specification and Claims.

Figure 4B:
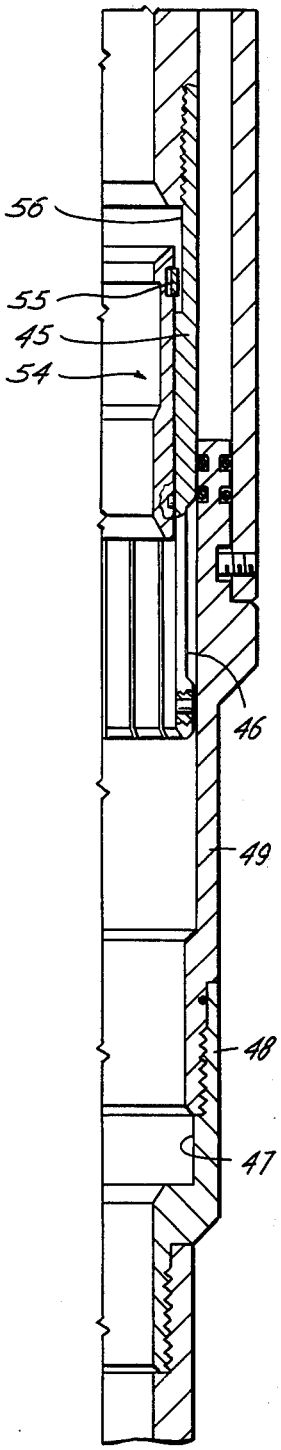
Figure 3B:
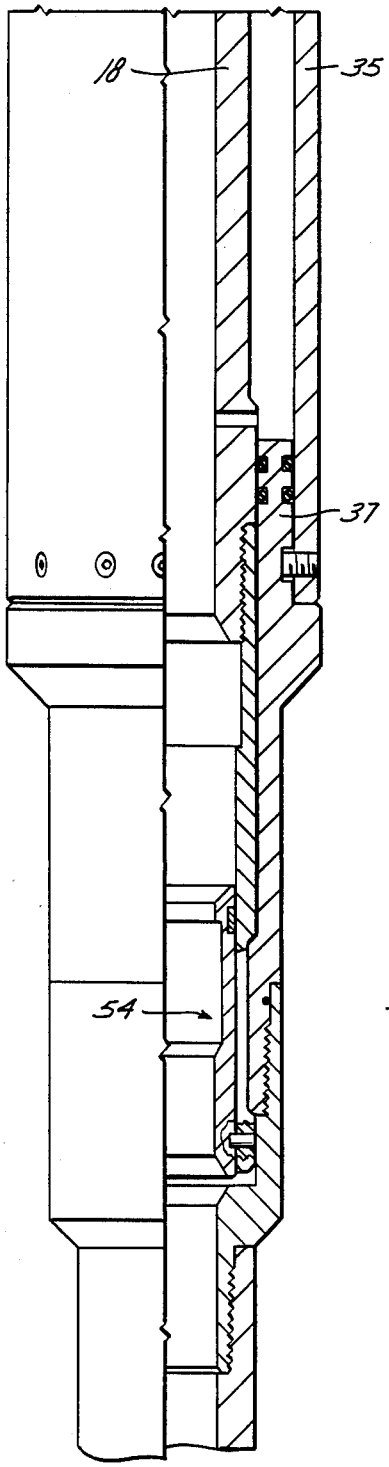

In the Drawings wherein an illustrative embodiment of this invention is shown and wherein like reference numerals indicate like parts, FIG. 1 is a schematic illustration of the well tool of this invention in a dual packer arrangement with the dual packer system shown in elevation in a well with the well casing shown in section at the producing zones;

FIGS. 2A and continuation view 2B are quarter sectional views between the center line and one side of the tool, showing the latch system with the parts in the run-in relationship;

FIG. 3A and continuation view FIG. 3B show a quarter sectional view of the latch system of the tool in latched position with the lugs against the downwardly looking no-go in the casing;

FIG. 4A and its continuation view FIG. 4B are a quarter section between the center line and one side of the tool showing the latch system in its released condition being pulled from the hole; and FIG. 5 is a view in quarter section of a modified form of latch dogs.

Referring first to FIG. 1, a well is shown having a casing 10 perforated at 11 and 12 for production from dual zones. In accordance with this invention the well is preferably provided with a no-go nipple 13 above the upper formation 11 and a no-go nipple 14 intermediate the two producing zones. Each of the nipples are of the well known polished bore type in which the bore through the nipple is slightly reduced and this reduced bore section of each nipple is intended to be engaged by seals on packers to pack off the casing above the formations and intermediate the two formations.

The well head is indicated generally at 15 and may be of conventional construction to produce a dual zone well.

The well tool is indicated generally at 16 and when the invention is employed with a multiple packer system, an upper no-go 17 is preferably employed to engage the no-go nipple 13 and limit downward movement of the tool. While other types of suspension could be provided such as lugs, latch keys, or the like, the simple no-go system is preferred due to its simplicity. It is also apparent that the upper no-go could be omitted and the upper stop system provided by slips, but this is the least preferred form of system due to the possibility of slips ballooning the casing. The tubing 18 may be considered to be a mandrel on which the remaining elements of the tools are carried.

When the invention is employed with a multiple packer system, a conventional packer such as the smooth bore dual packer indicated generally at 19 may be employed to seal with the upper no-go nipple 13. As this packer is a conventional smooth bore type packer employing seals 21 spaced axially therealong, its details are not shown and will not be described.

In accordance with the invention as applied to multiple packer systems, a lower packer, such as the single packer indicated generally at 22, is carried on the mandrel 18 in a position in which its seals 23 will engage the polished bore of the lower no-go nipple 14. As the distance between the two nipples 13 and 14 may be substantial and space-out problems may be present, it is preferred that the seal system of the packers be such that when the packers are run in the well and the upper no-go 17 is landed, the seal system of the lower packer will be of sufficient length to have seals in engagement with the polished bore of the lower no-go nipple 14 to insure sealing between the packer and nipple at this point.

A latch indicated generally at 24 is carried by the mandrel 18 below the lower packer 22. During the running of the tool this latch system will be spaced a considerable distance below the lower packer 22. For instance the spacing may be on the order of six feet (6') so that the operator will be certain that the latch 24 is below the lower no-go nipple 14 when the upper no-go 17 seats in the upper no-go nipple 13. At this time the lower end of the tubing is temporarily closed as by utilizing a temporary closure device such as a pump-out ball. Pump-out balls are shown in U.S. Pat. No. 3,288,218, and in the Composite Catalog of Oil Field Equipment and Services, 32nd Revision, 1976–1977, Volume 3, Page 4521. As they are well known devices their construction and operation will not be further described here.

The pump-out ball catcher is shown at 25 with the ball shown therein in dashed lines at 26. With the ball in place to provide a plug in the bottom of the tool, pressure is exerted in the tool to force the latch system up into engagement with the downwardly looking shoulder of the no-go nipple 14. The latch system is such that the latches are automatically maintained in this position after pressure is relieved and preferably pressure is exerted in sufficient amount to place the mandrel 18 between the two packers in tension so that the operator will be assured that there is no possibility of the mandrel 18 corkscrewing and permitting the lower packer seals to become disengaged due to upward movement of the lower packer. After the latch 24 is set the ball 26 is pumped out of the mandrel and the well is ready for production.

In accordance with this invention the latch system 24 is readily released as by wireline operation and when released the system may be removed from the well in the conventional manner.

Figure 2B:
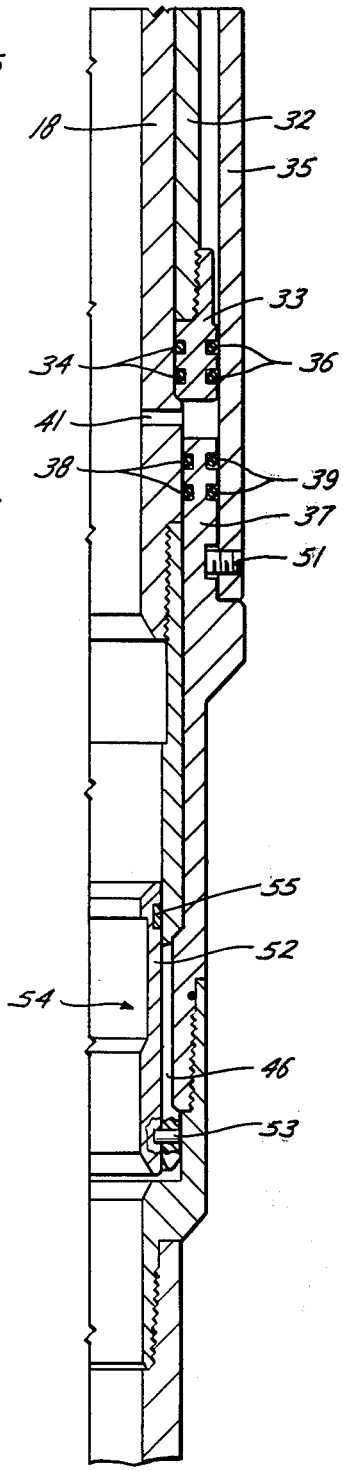

Reference is now made to FIGS. 2A and 2B in which the latch means is shown to be carried on the lower section of the mandrel 18 and to be in position with the latch system well below the no-go shoulder of the casing no-go nipple 14 with the tool in the run in position. The spacing between the latch system and the no-go shoulder would be selected by the operator to be certain that the latch system is below the lower casing no-go 14 but is, of course, within the capabilities of the latch system to engage the no-go shoulder.

The latch means includes retractable and expansible lugs which are movable axially along the mandrel and engageable with the downwardly facing no-go shoulder within the casing nipple 14. Of course, with them in this position they would limit upward movement of the tool. The lugs may follow any conventional system such as that shown in FIG. 2A. A lug carrier 27 is provided which has spaced circumferentially around the tool and within the carrier a plurality of lugs 28 arranged to move radially inward and outward. In the system shown the mandrel 18 has a reduced diameter section or groove 18*a* and the lugs 28 in the running condition are retracted into this reduced diameter groove. They are held in this position in any conventional manner as by shear pin 29. The lug carrier may be held against axial movement during running by shear pin 31. Thus, with the lug system as shown during running condition the lugs are retracted and will readily pass through the no-go nipples in the casing.

In order to extend the lugs radially and to move them axially along the mandrel into engagement with the downwardly facing no-go 14*a* of nipple 14, a suitable means is provided for moving the latch means upwardly into engagement with the downwardly facing no-go shoulder. In the illustrative embodiment, a sleeve 32 is secured to the lug carrier 27 and extends downwardly therefrom. The sleeve has secured to its lower end an annular piston 33 with suitable seals 34 sealingly engaging the mandrel 18.

An outer sleeve 35 cooperates with the mandrel 18 to provide an annulus in which the piston 33 is movable. Suitable seals 36 seal between the piston 33 and the outer sleeve 35.

The annulus provided by the mandrel 18 and the outer sleeve 35 is sealed at its lower end by a sub 37 having seals 38 sealing with the mandrel and seals 39 sealing with the outer sleeve 35.

In order to pressure up the annulus between the mandrel and sleeve 35, a port 41 is provided in the mandrel 18 just below the piston 36.

The completion or setting operation is illustrated in FIGS. 3A and 3B, which shows the system in the latched position. After dropping the ball 26 to close the lower end of the tool, pressure would be applied to the tool from the surface and would pass through the port 41 and be effective on the lower surface of piston 33. This application of pressure would result in upward movement of the sleeve 32 which would effect shearing of the pin 29 which holds the lugs retracted in the lug carrier and would shear pin 31 to release the lug carrier from the mandrel 18*a*. After these pins are sheared continued application of fluid pressure within the long string from the surface would result in pumping the latch system upwardly until the lugs 28 are extended outwardly by the larger diameter section of the mandrel 18. That is the section immediately above the groove 18*a*. Continued pumping of fluid would move the latch means upwardly until the lugs 28 engage the downwardly looking shoulder 14*a* of the lower no-go nipple 14. Preferably, pressure is continued and is of a substantial amount such as 1,000 p.s.i. to stretch the mandrel 18 between the upper and lower no-go casing nipples so that the mandrel 18 is placed in tension and will be able to withstand further operations without either of the packers being moved sufficient to disengage their seals. For instance, the formations might be treated with acid or conventional fracturing techniques in which high pressure is utilized and the latching system illustrated would prevent such high pressures from moving either the upper or lower packer sufficient to disengage their seals from the polished bores within the no-go nipples.

In order to maintain the latch in the latch position, a releasable means is provided that prevents movement of the latch means downwardly from the relatively large diameter section of the mandrel 18 to the relatively small diameter section provided by groove 18*a*. In the illustrative embodiment the upper end of the outer sleeve 35 carries a slip bowl 42 in which a plurality of slips 43 are urged downwardly by spring 44. The slips 43 are provided with teeth which are designed to prevent downward movement of the piston sleeve 32 relative to the outer sleeve 35 which carries the slip bowl. This outer sleeve is supported against downward movement on the sub 37 which is in turn releasably carried by the mandrel 18. Thus, when the lug carrier is pumped upwardly the slips 43 permit it to move upwardly relative to the slip bowl 42, but after the tool is set with the lugs in contact with the lower casing no-go 14, the slips 43 prevent downward movement of the latch and maintain the lugs in engagement with the lower no-go 14 as illustrated in FIGS. 3A and 3B.

Means are provided for rendering the releasable means ineffective and permitting the latch means to move from the second position in which the dogs are expanded and engaging the no-go shoulder 14*a* back to the first position in which the tool was run to permit the dogs to return to their retracted position. This relationship is shown in FIGS. 4A and 4B.

Preferably, the releasable means is a latch system which latches the mandrel 18 to the slip bowl carrying sleeve 35. Preferably this latch is provided by a conventional collet 45, having collet fingers 46 which in the run and set position reside in the finger groove 47 in reducer sub 48. The reducer sub 48 depends from sub 49 to which the slip bowl carrying sleeve 35 is secured by pin 51.

Means are provided for holding the collet fingers expanded and this preferably is a prop-out sleeve 52 which in the run and set position is pinned to the collet by shear pin 53. The prop-out sleeve 52 has a suitable key configuration in its internal bore indicated generally at 54. This key configuration receives a shifting tool which may be run on a wireline to engage the prop-out sleeve and move it upwardly. In so doing the pin 53 is sheared and the prop-out sleeve moves in the conventional manner from the position shown in FIGS. 2B and 3B to the position shown in FIG. 4B. In this position the latch spring 55 expands into groove 56 within the collet and maintains the prop-out sleeve in the upper position. At this time the tool may be removed from the well by picking up on the two strings of tubing of which mandrel 18 is a part. The upward movement of mandrel 18 relative to the slip bowl 42 and lug carrier 27 will return the lower section of the mandrel and the lug carrier 27 to their run position in which the reduced diameter section or groove 18*a* in the mandrel underlies the lug carrier again and the lugs 28 are permitted to retract into the groove as the tool is pulled from the hole.

In FIG. 5 there is shown an alternative lug carrier 57 in which springs 59 urgeing the lugs inwardly instead of the shear pin 29 employed in the FIG. 2A form of the invention. Either type of lug carrier is satisfactory.

Also, as shown, the reduced diameter section of the mandrel might be provided by a joint in the mandrel with the mandrel including a section 18*b* having a section 18*c* depending therefrom and the mandrel section 18*b* having a reduced diameter portion 18*d*.

In operation the dual and single string packers are made up on the mandrel 18 together with the pump-out ball sub 25. The assembly is lowered as a unit until the upper no-go 17 engages the upper casing no-go 13. At this time the latch assembly is in the position shown in FIGS. 2A and 2B and the space-out has been designed to be sure that the lug carrier 27 is below the lower no-go 14. The ball 26 is dropped in the long string and seals off the open end of this string. The tubing is pressured up and pressure exerted on the piston 33 shears pins 31 and 29 on the lug carrier and moves the lug carrier upwardly expanding the lugs 28 radially and moving them upwardly into engagement with the downwardly looking no-go shoulder 14*a* in the casing. Preferably sufficient pressure is exerted to place the mandrel 18 between the two no-gos in tension to insure that the tool straddles the two casing no-gos and cannot move either upwardly or downwardly in subsequent operations in the well. The slips 43 engaging the sleeve 32 hold the latch carrier in the engaged position and after the latch is set the ball may be pumped out of the catcher 25 in the conventional manner to clear the long string for production of formation 12.

To remove the tool from the well a shifting tool is run in as on a wireline to engage the collet prop-out sleeve 52 and shear pin 53 and shift the prop-out sleeve up to the position shown in FIG. 4B where the ring 55 expands outwardly into the groove 56 and holds the prop-out sleeve in its upward position. At this time an upward pull on the tool will release the collet and it can be moved upwardly to the position shown in FIGS. 4A and 4B, at which time the dogs have been returned to their original position relative to the mandrel 18 and can retract into the groove 18*a* thereon, permitting the entire tool to be pulled from the well.

From the above it will be apparent that this invention is particularly useful where multiple packers are used. It is further apparent that more than two packers could be used if desired. Depending on space-out problems, an additional packer might be positioned between the two no-go shoulders in the casing or a packer might be positioned above or below the no-gos. It would be preferred, however, that all packers be between the two no-gos as the interconnecting tubing between packers would then be placed in tension and they could not corkscrew to permit disengagement of the packer seals.

It is also apparent that the system of the tool could be utilized to land a single packer in a well if desired. The system would be advantageous for a single packer in that it gives substantially all of the advantages of a permanent type packer, yet is removable from the hole.

It will be apparent that the latch and release system could take many different forms, it only being necessary that the latch can initially be positioned below the lower no-go in the well and then moved up into engagement with the lower no-go.

It is also apparent that while a pump control system to move the latch into engagement is illustrated and preferred, other systems could be utilized. Any system which will force the latch carrier upwardly into engagement with the lower no-go could be substituted.

It is also apparent that slips could be substituted for the upper no-go, but this would not be preferred.

The foregoing disclosure and description of the invention are illustrative and explanatory thereof and various changes in the size, shape and materials, as well as in the details of the illustrated construction, may be made within the scope of the appended Claims without departing from the spirit of the invention.

What is claimed is:

1. A well tool comprising, a mandrel, means on the mandrel engageable with a casing to prevent downward movement of the mandrel, latch means movable axially upwardly along the mandrel and engageable with a no-go shoulder within a casing to prevent upward movement of the mandrel, means for expanding and moving said latch means axially upwardly along the mandrel from a first lower retracted position to a second upper expanded position in engagement with said shoulder, releasable means preventing movement of the latch means from said second position to said first position, and means rendering said releasable means ineffective and permitting said latch means to move from said second to said first position.

2. The well tool of claim 1 wherein, at least one seal means is carried by the mandrel to seal the annulus between the mandrel and a casing and the means for limiting downward movement of the tool is a no-go shoulder.

3. The well tool of claim 1 wherein, the means for rendering the releasable means ineffective includes a collet and a prop-out sleeve movable to a position to release the collet.

4. A well tool comprising, a mandrel, a no-go shoulder on the upper section of the mandrel engageable with an upwardly facing no-go shoulder in a casing to limit downward movement of the tool, latch means carried by the lower section of the mandrel including retractable and expansible lugs movable axially along the mandrel and engageable with a downwardly facing no-go shoulder within a casing to limit upward movement of the tool, said mandrel having a relatively smaller diameter section underlying the lugs when in retracted position and a relatively larger diameter section thereabove to maintain the lugs expanded while they engage with the downwardly facing no-go shoulder, means for moving the latch means upwardly into engagement with the downwardly facing no-go shoulder, releasable means preventing movement of the latch means downward from the larger diameter to the smaller diameter section of the mandrel, collet means securing the releasable means to the mandrel and collapsible to release the releasable means and permit relative movement of the latch means and mandrel to position the lugs over the smaller section of the mandrel, and a shiftable prop-out sleeve for selectively preventing collapse of said collet.

5. The tool of claim 4 wherein, at least one seal means is provided on the mandrel for sealing the annulus between the tool and a casing.

6. A multiple packer system for well completions comprising, a mandrel, means at the upper end of the mandrel engageable with a casing to limit downward movement of the mandrel, a multiple string packer on the upper section of the mandrel, a packer on the lower section of the mandrel, a packer on the lower section of the mandrel, latch means on the lower end of the mandrel and movable upwardly along the lower section of the mandrel from a retracted position to an expanded position where it is engageable with a downwardly facing no-go shoulder in a casing to limit upward movement of the mandrel, means for moving said latch means upwardly along the mandrel, releasable means for preventing downward movement of the latch means along the mandrel, and means for releasing said releasable means permitting said latch means to move to retracted position.

* * * * *